US010378177B2

(12) United States Patent
Hout

(10) Patent No.: US 10,378,177 B2
(45) Date of Patent: Aug. 13, 2019

(54) SPUD CARRIER

(71) Applicant: IHC Holland IE B.V., Sliedrecht (NL)

(72) Inventor: Corné Hout, Poortvliet (NL)

(73) Assignee: IHC Holland IE B.V., Sliedrecht (NL)

( * ) Notice: Subject to any disclaimer, the term of this patent is extended or adjusted under 35 U.S.C. 154(b) by 0 days.

(21) Appl. No.: 15/559,461

(22) PCT Filed: Mar. 18, 2016

(86) PCT No.: PCT/NL2016/050192
§ 371 (c)(1),
(2) Date: Sep. 19, 2017

(87) PCT Pub. No.: WO2016/153342
PCT Pub. Date: Sep. 29, 2016

(65) Prior Publication Data

US 2018/0112373 A1 Apr. 26, 2018

(30) Foreign Application Priority Data

Mar. 20, 2015 (NL) ..... 2014491

(51) Int. Cl.

| | |
|---|---|
| ***E02F 3/90*** | (2006.01) |
| ***B63H 19/08*** | (2006.01) |
| ***E02F 9/06*** | (2006.01) |
| ***E02F 3/88*** | (2006.01) |

(52) U.S. Cl.
CPC ..... *E02F 3/905* (2013.01); *B63H 19/08* (2013.01); *E02F 3/885* (2013.01); *E02F 9/062* (2013.01)

(58) Field of Classification Search
CPC . E02F 3/905; E02F 3/885; E02F 9/062; E02F 9/065; B63H 19/08
See application file for complete search history.

(56) References Cited

U.S. PATENT DOCUMENTS 3,656,449 A * 4/1972 Mead ..... E02F 9/062 37/346
4,342,164 A 8/1982 Claassen
(Continued)

FOREIGN PATENT DOCUMENTS

DE 1912311 12/1969
EP 0227143 A1 7/1987
(Continued)

*Primary Examiner* — Jamie L McGowan
(74) *Attorney, Agent, or Firm* — N.V. Nederlandsch Octrooibureau; Catherine A. Shultz; Katelyn J. Bernier

(57) ABSTRACT

A spud system for a dredging vessel with a longitudinal direction includes a spud carrier for mounting a spud therein in a generally vertical stance and a spud carrier cable driving device coupled with the dredging vessel and the spud carrier for driving the spud carrier with respect to the dredging vessel. The spud carrier is moveable with respect to a longitudinal direction of the dredging vessel for advancing the dredging vessel. The spud carrier cable driving device comprises at least an aft cable drive system which extends at an aft side of the spud carrier, and a fore cable drive system separate from the aft cable drive system. The fore cable drive system extends at a fore side of the spud carrier, and each of the aft cable drive system and the fore cable drive system is coupled with the dredging vessel and the spud carrier

20 Claims, 2 Drawing Sheets

(56) References Cited

U.S. PATENT DOCUMENTS

| | | | | | |
|---|---|---|---|---|---|
| 4,432,420 | A * | 2/1984 | Gregory | E21B 19/09 166/355 |
| 7,900,381 | B2 * | 3/2011 | Clymans | F28F 1/325 114/295 |
| 2009/0126237 | A1 * | 5/2009 | Clymans | E02F 9/062 37/317 |
| 2017/0089037 | A1 * | 3/2017 | Knol | E02F 9/062 |

FOREIGN PATENT DOCUMENTS

| | | | | |
|---|---|---|---|---|
| EP | 2258904 | B1 | 12/2010 | |
| GB | 176792 | | 5/1928 | |
| JP | 01131734 | | 5/1989 | |
| JP | 01226939 | A * | 9/1989 | E02F 3/8841 |
| NL | 162164 | C | 4/1979 | |
| NL | 1011753 | C | 12/2000 | |
| NL | 1011754 | C | 12/2000 | |
| WO | 2006/130934 | A2 | 12/2006 | |
| WO | WO-2013157944 | A1 * | 10/2013 | E02F 3/8841 |

* cited by examiner

SPUD CARRIER

BACKGROUND

The present invention relates to a spud system for a dredging vessel with a longitudinal direction, which spud system comprises;

a spud carrier for mounting a spud therein in a generally vertical stance and which spud carrier is moveable with respect to the longitudinal direction of the dredging vessel for advancing the dredging vessel, and a spud carrier cable driving device coupled with the dredging vessel and the spud carrier for driving the spud carrier with respect to the dredging vessel.

In general a cutter suction dredger is fitted with a spud carrier that allows the dredger to be pushed forward when the working spud mounted in the spud carrier has penetrated into the bottom. Typical systems for driving a spud carrier include hydraulic systems and wire systems.

WO2006130934 shows a system which drives spud carriers by means of a hydraulic system. Such a system requires a complex hydraulic cylinder for driving the carriage.

NL 1011753 is an example of a spud system having a wire system with crossing wires. The crossing wires of the system may cause a number of problems during operations.

In circumstances where large external forces are exerted on the dredger due to sea currents, waves, swell or other causes, overloading of the spud and/or the spud carrier cylinder (which drives the spud carrier) is prevented by allowing the spud to move and thus give way to the overload. However in view of production capacity of the cutter suction dredger, it is important that the neutral position of the spud carrier is well defined and that, after removal of the overload condition, the spud carrier quickly returns to that neutral position. The neutral position refers to the carrier and the spud wherein the spud takes a vertical stance.

It is known for spud carriers to be held in vertical position by means of a wire system, and the overload protection can be realized by allowing at least one of the sheaves to move. As a result the spud carrier will rotate and give way to the overload. Simply connecting a gas spring (accumulator) to this wire system prevents overloading, but has as a consequence that there is no well-defined fixed position of the spud before and after an overload. Such a spud carrier system with overload protection is known from WO2006130934, wherein an apparatus is disclosed for accommodating a substantially vertical spud of a dredging vessel with a longitudinal direction, comprising a spud carriage which is mounted for limited rotation around a horizontal transverse axis, wherein at least a first and a second spring means is arranged under bias between vessel and spud in the longitudinal direction for the purpose of absorbing a moment on the spud carriage, which first and second spring means compensate each other in the non-loaded situation of the spud; and—at least one spring means is provided with a spring force limiting means for limiting the tension in said spring element from a determined maximum moment on the spud carriage.

SUMMARY OF THE INVENTION

The invention aims to provide a simple drive system for spud carrier.

According to a first aspect of the invention, a spud system for a dredging vessel with a longitudinal direction comprises;

a spud carrier for mounting a spud therein in a generally vertical stance, the spud carrier being moveable with respect to the longitudinal direction of the dredging vessel for advancing the dredging vessel, and a spud carrier cable driving device coupled with the dredging vessel and the spud carrier for driving the spud carrier with respect to the dredging vessel, wherein the spud carrier cable driving device comprises at least an aft cable drive system which extends at an aft side of the spud carrier, and a fore cable drive system separate from the aft cable drive system, wherein the fore cable drive system extends at a fore side of the spud carrier, and wherein each of the aft cable drive system and the fore cable drive system is coupled with the dredging vessel and the spud carrier.

This spud system provides for an effective drive system for the spud carrier with a simple mechanical construction, no longer requiring a complex hydraulic cylinder for driving the spud carrier. In addition, since separate cable systems each extend only at one side of the spud carrier (fore or aft), the crossing of wires is avoided, eliminating the difficulties associated with crossed wires during operation of the spud system.

In an embodiment of the spud system, at least one of the aft cable drive system and fore cable drive system comprises at least an upper cable drive system and a lower cable drive system, wherein each of the upper cable drive system and lower cable drive system is coupled with the dredging vessel and the spud carrier such that a spud mounted in the spud carrier maintains a generally vertical stance. This way, the spud carrier cable driving systems drives the spud carrier and maintains the, usually vertical, stance of the spud. This opens the possibility to integrate a load limiting device for the spud system in the spud carrier cable driving device. Such a load limiting device for the spud system is also referred to as a "spud guard".

In an embodiment of the spud system, each cable drive system comprises a cable and a winch, wherein the winch of the upper cable drive system and the winch of the lower cable drive system are operationally coupled for equally paying out or hauling in the cable of the upper cable drive system and the cable of the lower cable drive system such that a spud mounted in the spud carrier maintains a generally vertical stance.

In an embodiment of the spud system, at least one of the cable drive systems comprises a cable drawback pulley, wherein one end of the cable is coupled with the vessel and the other end of the cable is coupled with the winch for pulling the spud carrier towards the winch or allowing the spud carrier to move away from the winch. Optionally, the drawback pulley is coupled with the spudcarrier, the winch is mounted on the vessel, and the cable extends around the drawback pulley.

In an embodiment of the spud system, a winch of the upper cable drive system and a winch of the lower cable drive system have a winch driving axis in common such that the winch of the upper cable drive system and the winch of the lower cable drive system are equally driven such that a spud mounted in the spud carrier maintains a generally vertical stance. This simplifies the spud system and its operation and control by ensuring that the cable drive systems are equally driven.

In an embodiment of the spud system, at least one cable drive system comprises an auxiliary sheave between the winch and the drawback pulley for guiding the cable. This enables lowering of the mounting position of the drawback pulley that is coupled to the spud carriage. This way, the generally vertical stance of the spud is maintained with more ease.

In an embodiment of the spud system, an upper cable drive system and lower cable drive system extend from the aft side of the spud carrier towards the dredging vessel and an upper cable drive system and a lower cable drive system extend from the fore side of the spud carrier towards the dredging vessel.

In an embodiment of the spud system, the upper and lower cable drive systems on the aft side and fore side of the spud carrier each comprise parallel upper and lower cable drive systems arranged at the starboard-side and port-side of the spud carrier. This arrangement provides room for the spud when the spud needs to cant between its generally vertical position and a horizontal position.

In an embodiment of the spud system, the cable drive system arranged at the starboard-side and the cable drive system arranged at the port-side have a winch driving axis in common.

In an embodiment of the spud system, at least one of the aft cable drive system and fore cable drive system comprises a plurality of parallel cable drive systems.

In an embodiment of the spud system, at least one cable drive system is coupled with the spud carrier through a load limiting device. This integrates a load limiting device for the spud system into the spud carrier cable driving device in a simple manner.

In an embodiment of the spud system, the load limiting device comprises a centring cylinder and the fore cable drive system and aft cable drive system are coupled with the spud carrier through the self centring cylinder. This enables the load limiting device to force the spud carrier to return to a predetermined position, also referred to as neutral position.

In an embodiment, the centring cylinder comprises a pair of opposite pressurized fluid chambers, and a central pressurized fluid chamber. The pair of opposite pressurized fluid chambers and central pressurized fluid chamber are formed by a pair of pistons and rods, one piston and rod coupled to each of fore and aft cable drive systems.

In an embodiment, the pair of opposite pressurized fluid chambers and/or the central pressurized fluid chamber are in fluid connection with an accumulator system. Optionally, the accumulator system comprises a source of pressure and the central pressurized fluid chamber is in fluid connection with the source of pressure. By connecting one or more of the pressurized fluid chambers to an accumulator system, the pressure on the cylinders can be controlled, and therefore the movements of the cylinder and the cable drive systems can be controlled.

In an embodiment, the accumulator system comprises a number of sources of pressure and the pressurized fluid chambers are each in fluid connection with a respective source of pressure.

In an embodiment, the accumulator system comprises an accumulator with an adjustable gas pressure in order to be able to adjust the centring force. By using an accumulator with an adjustable gas pressure, pressure can be adjusted to be able to adequately compensate for whatever conditions are present.

The spud system can be part of a dredger.

The invention further relates to a device comprising one or more of the characterising features described in the description and/or shown in the attached drawings.

The invention further relates to a method comprising one or more of the characterising features described in the description and/or shown in the attached drawings.

The various aspects discussed in this patent can be combined in order to provide additional advantageous advantages.

DETAILED DESCRIPTION OF EMBODIMENTS

Figure 1:
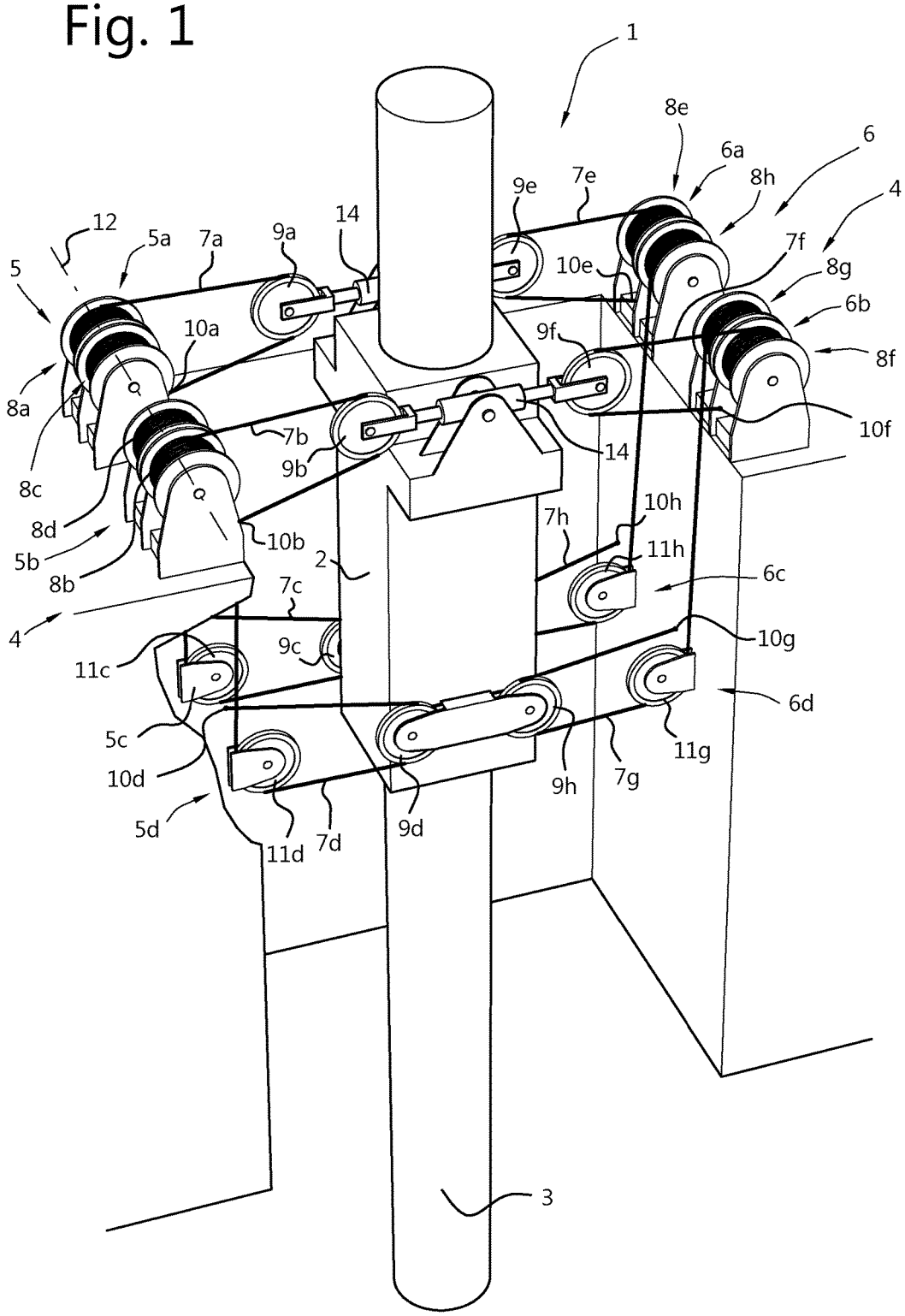
FIG. 1 in perspective view a spud system according to the invention.

FIG. 1 shows in perspective view spud system 1. The spud system 1 is suitable for use in a dredging vessel (not shown).

The spud system 1 comprises a spud carrier 2 and a spud 3 mounted therein in a generally vertical stance. The spud carrier 2 is moveable with respect to the longitudinal direction of the dredging vessel, and is used for advancing the dredging vessel in a manner which is known per se.

The spud system 1 comprises a spud carrier cable driving device generally referred to with reference number 4. The spud carrier cable driving device is coupled with the dredging vessel and the spud carrier 2 for driving the spud carrier with respect to the dredging vessel. The spud carrier cable driving device 4 comprises at least an aft cable drive system 5 and a fore cable drive system 6. The aft cable drive system 5 extends only at the aft side of the spud carrier 2. The fore cable drive system 6 extends only at the fore side of the spud carrier 2. The fore cable drive system 6 is separate from the aft cable drive system 5. Each of the aft and fore cable drive systems is coupled with the dredging vessel and the spud carrier. The aft and fore cable drive systems work in parallel.

In this case, each of the aft cable drive system 5 and the fore cable drive system 6 of the spud carrier cable driving device system 4 comprises an upper and a lower cable drive system, with two parallel drive systems working in parallel on each of the upper and lower cable drive systems. Aft cable drive system 5 includes upper cable drive systems 5*a*, 5*b* working in parallel and lower cable drive systems 5*c*, 5*d* working in parallel. Fore cable drive system 6 includes upper cable drive systems 6*a*, 6*b* working in parallel and lower cable drive systems 6*c*, 6*d* working in parallel. Each of the upper and lower cable drive systems is coupled with the dredging vessel and the spud carrier such that a spud mounted in the spud carrier maintains a generally vertical stance. In this case, respective upper and lower cable drive systems extend from both the aft and fore side of the spud carrier towards the dredging vessel. As an example, respective upper and lower cable drive systems are arranged both at the starboard- and port-side of the spud carrier 2, working in parallel. In other embodiments, only one cable drive system can be used in upper cable drive system and/or lower cable drive systems. In a further embodiment, more than two parallel cable drive systems can be used in upper and/or lower cable drive systems or only one cable drive system can be used.

The cable drive systems each comprise a cable 7*a*-7*h*. A winch 8*a*-8*h* can also be provided for each cable drive system. Winches 8*a*, 8*b*, 8*e*, 8*f* of the upper cable drive systems 5*a*, 5*b*, 6*a*, 6*b* and the winches 8*c*, 8*d*, 8*g*, 8*h* of the lower cable drive systems 5*c*, 5*d*, 6*c*, 6*d* can be respectively operationally coupled for equally paying out or hauling in the cable of the upper cable drive system and the cable of the lower cable drive system, ensuring that a spud mounted in the spud carrier maintains a generally vertical stance.

The upper cable drive systems 5*a*, 5*b*, 6*a*, 6*b* each comprise a cable drawback pulley 9*a*, 9*b*, 9*e*, 9*f* One end 10*a* of the cable 7*a* is coupled with the vessel and the other end of the cable 7*a* is coupled with the winch 8*a* for pulling the spud carrier 2 towards the winch or allowing the spud carrier to move away from the winch 8*a*. All respective cable drive systems 5*a*-5*d* and 6*a*-6*d* have a respective cable drawback pulley 9*a*-9*h*. The drawback pulley is coupled with the spud carrier 2. The winch is mounted on the vessel. The respective cable extends or is wound around the respective cable drawback pulley.

Here, the lower cable drive systems 5*c*, 5*d*, 6*c*, 6*d* each comprise an auxiliary sheave 11*c*, 11*d*, 11*g*, 11*h* between the winch 8*c*, 8*d*, 8*g*, 8*h* and the drawback pulley 9*c*, 9*d*, 9*g*, 9*h* for guiding the cable 7*c*, 7*d*, 7*g*, 7*h*.

Optionally, the winch of the upper cable drive system and the winch of the lower cable drive system have a winch driving axis 12 in common. In such a system, the winch of the upper cable drive system and the winch of the lower cable drive system are equally driven, helping to ensure that a spud mounted in the spud carrier maintains a generally vertical stance.

One or more cable drive systems (5*a*, 5*c*, 6*a*, 6*c*) can be arranged at the starboard side and one or more cable drive systems (5*b*, 5*d*, 6*b*, 6*d*) can be arranged at the port-side of the vessel. These cable drive systems at port side and starboard side can have a winch driving axis 12 in common. Having two or more parallel cable drive systems, as shown in FIG. 1, can help in situations where there is a particularly heavy load. Other embodiments could have only one cable drive system, more than two parallel cable drive systems and/or only upper or lower cable drive systems. Additionally, when there are two or more cable drive systems on a side, the winch driving axis can be in common or can be separate.

Figure 2:
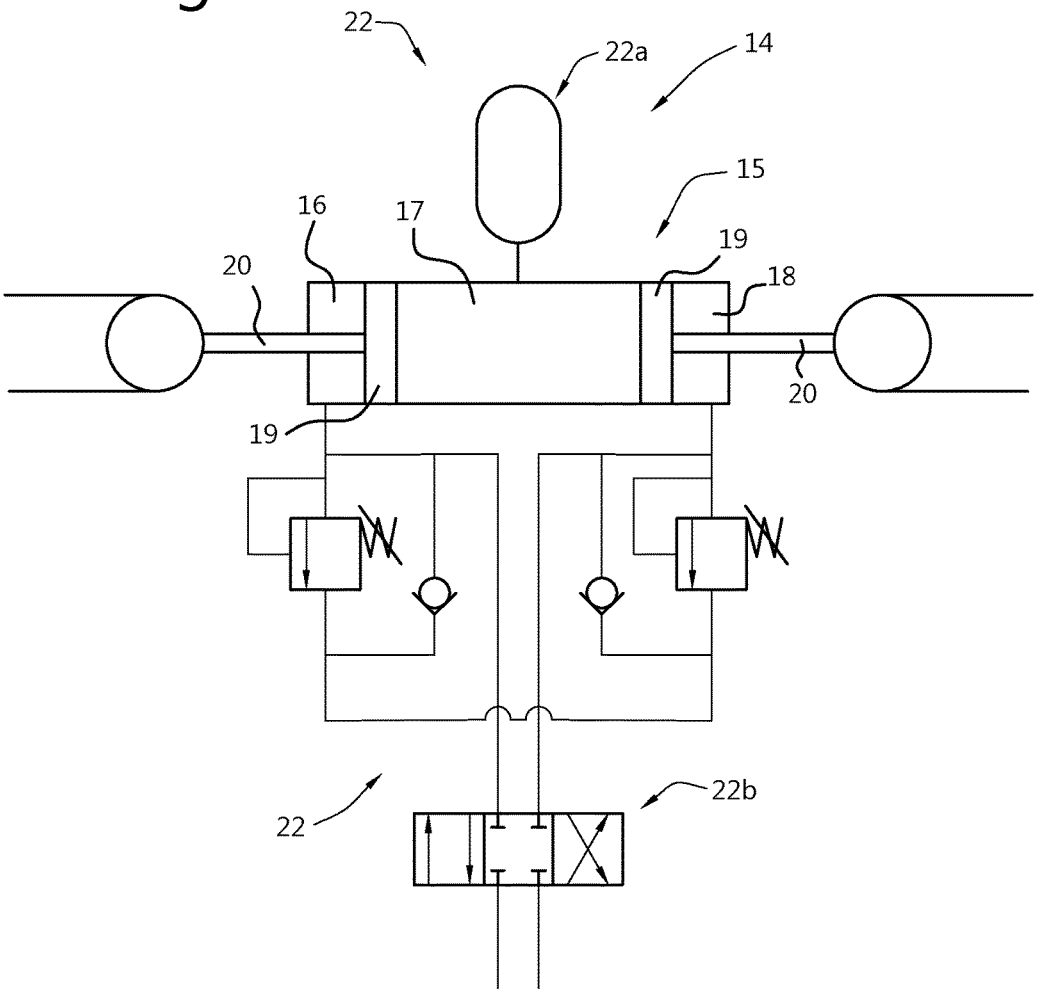
FIG. 2 shows a load limiting device for use in the spud system according to FIG. 1.

As an option, both aft cable drive system 5 and fore cable drive system 6 can be coupled with the spud carrier 2 through a load limiting device 14. An example of such a load limiting device is shown in more detail in FIG. 2.

Load limiting device 14 includes centering cylinder 15, pressure chambers 16, 17, 18, pistons 19 and rods 20, and accumulator system 22. Accumulator system 22 can include a number of pressure sources 22*a*, 22*b* which can be connected to the pair of opposite pressure chambers 16, 18, formed by pistons 19 which respectively connect to fore and aft cable drive systems through rods 20; and to central pressurized fluid chamber 17. The different pressure sources 22*a*, 22*b*; which provide pressure chambers 16, 17, 18 with pressurized fluid can work to provide overload protection to cable drive systems by helping to keep cables taut during operations. The pressure sources 22*a*, 22*b*, can be, for example, an accumulator with an adjustable gas pressure and/or a number of respective sources of pressure. Such a system with a load limiting device 14 can help to keep cables taut, giving overload protection to cable drive system 1.

It will also be obvious after the above description and drawings are included to illustrate some embodiments of the invention, and not to limit the scope of protection. Starting from this disclosure, many more embodiments will be evident to a skilled person which are within the scope of protection and the essence of this invention and which are obvious combinations of prior art techniques and the disclosure of this patent.

The invention claimed is:

1. A spud system for a dredging vessel with a longitudinal direction, which spud system comprises;

a spud carrier for mounting a spud therein in a generally vertical stance, the spud carrier being moveable with respect to the longitudinal direction of the dredging vessel for advancing the dredging vessel, and a spud carrier cable driving device coupled with the dredging vessel and the spud carrier for driving the spud carrier with respect to the dredging vessel, wherein the spud carrier cable driving device comprises at least an aft cable drive system which extends at an aft side of the spud carrier for driving the spud carrier in a longitudinal direction with respect to the vessel, and a fore cable drive system separate from the aft cable drive system, wherein the fore cable drive system extends at a fore side of the spud carrier for driving the spud carrier in a longitudinal direction with respect to the vessel, and wherein each of the aft cable drive system and the fore cable drive system is coupled with the dredging vessel and the spud carrier.

2. The spud system according to claim 1, wherein at least one of the aft cable drive system and the fore cable drive system of the spud carrier cable driving device system comprises at least an upper cable drive system and a lower cable drive system, wherein each of the upper cable drive system and lower cable drive system is coupled with the dredging vessel and the spud carrier such that a spud mounted in the spud carrier maintains a generally vertical stance.

3. The spud system according to claim 2, wherein each cable drive system comprises a cable and a winch, wherein the winch of the upper cable drive system and the winch of the lower cable drive system are operationally coupled for equally paying out or hauling in the cable of the upper cable drive system and the cable of the lower cable drive system such that a spud mounted in the spud carrier maintains a generally vertical stance.

4. The spud system according to claim 1, wherein at least one of the cable drive systems comprises a cable drawback pulley, wherein one end of the cable is coupled with the vessel and the other end of the cable is coupled with the winch for pulling the spud carrier towards the winch or allowing the spud carrier to move away from the winch.

5. The spud system according to claim 4, wherein the drawback pulley is coupled with the spudcarrier, the winch is mounted on the vessel, and the cable extends around the drawback pulley.

6. The spud system according to claim 2, wherein a winch of the upper cable drive system and a winch of the lower cable drive system have a winch driving axis in common such that the winch of the upper cable drive system and the winch of the lower cable drive system are equally driven such that a spud mounted in the spud carrier maintains a generally vertical stance.

7. The spud system according to claim 4, wherein at least one cable drive system comprises an auxiliary sheave between the winch and the drawback pulley for guiding the cable.

8. The spud system according to claim 2, wherein an upper cable drive system and lower cable drive system extend from the aft side of the spud carrier towards the dredging vessel and an upper cable drive system and a lower cable drive system extend from the fore side of the spud carrier towards the dredging vessel.

9. The spud system according to claim 8, wherein the upper and lower cable drive systems on the aft side and fore side of the spud carrier each comprise parallel upper and lower cable drive systems arranged at the starboard-side and port-side of the spud carrier.

10. The spud system according to claim 9, wherein the cable drive system arranged at the starboard-side and the cable drive system arranged at the port-side have a winch driving axis in common.

11. The spud system according to claim 1, wherein at least one of the aft cable drive system and fore cable drive system comprises a plurality of parallel cable drive systems.

12. The spud system according to claim 1, wherein at least one of the cable drive systems is coupled with the spud carrier through a load limiting device.

13. The spud system according to claim 12, wherein the load limiting device comprises a centring cylinder and the fore cable drive system and aft cable drive system are coupled with the spud carrier through the self centring cylinder.

14. The spud system according to claim 13, wherein the centring cylinder comprises a pair of opposite pressurized fluid chambers, and a central pressurized fluid chamber, wherein the pair of opposite pressurized fluid chambers and central pressurized fluid chamber are formed by a pair of pistons and rods, one piston and rod coupled to each of the fore and aft cable drive systems.

15. The spud system according to claim 14, wherein the pair of opposite pressurized fluid chambers and/or the central pressurized fluid chamber are in fluid connection with an accumulator system.

16. The spud system according to claim 15, wherein the accumulator system comprises a source of pressure and the central pressurized fluid chamber is in fluid connection with the source of pressure.

17. The spud system according to claim 15, wherein the accumulator system comprises a number of sources of pressure and the pressurized fluid chambers are each in fluid connection with a respective source of pressure.

18. The spud system according to claim 15, wherein the accumulator system comprises an accumulator with an adjustable gas pressure in order to be able to adjust the centring force.

19. A dredger comprising the spud system according to claim 1.

20. The spud system according to claim 1, wherein the aft cable drive system and fore cable drive system work in parallel.

* * * * *